US009237790B2

(12) United States Patent
Takagi

(10) Patent No.: US 9,237,790 B2
(45) Date of Patent: Jan. 19, 2016

(54) HEAD-HAIR TREATMENT-AGENT APPLICATOR

(75) Inventor: Yoshimasa Takagi, Tokyo (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 13/703,484

(22) PCT Filed: Jun. 10, 2011

(86) PCT No.: PCT/JP2011/063365

§ 371 (c)(1),
(2), (4) Date: Feb. 26, 2013

(87) PCT Pub. No.: WO2011/155599

PCT Pub. Date: Dec. 15, 2011

(65) Prior Publication Data

US 2013/0174860 A1 Jul. 11, 2013

(30) Foreign Application Priority Data

Jun. 11, 2010 (JP) ..... 2010-134268

(51) Int. Cl.
*A45D 24/22* (2006.01)
*A45D 19/02* (2006.01)
(Continued)

(52) U.S. Cl.
CPC ..... *A45D 24/22* (2013.01); *A45D 19/02* (2013.01); *A45D 24/26* (2013.01); *A45D 34/042* (2013.01); *A46B 11/002* (2013.01);
(Continued)

(58) Field of Classification Search
CPC .... A46B 9/023; A46B 9/028; A46B 11/0041; A46B 11/002; A46D 1/0238; A46D 1/0276; A46D 1/0284; A45D 24/22; A45D 24/26; A45D 19/008; A45D 2019/0066; A45D 34/042
USPC ..... 132/107, 112–116, 158, 159, 901; 15/207.2, DIG. 15, 142, 186–188; D4/136; D28/7, 21–34; 222/148–150, 222/191, 192; 119/625–633, 612, 615, 616, 119/664
See application file for complete search history.

(56) References Cited

U.S. PATENT DOCUMENTS 1,720,017 A * 7/1929 Touchstone ..... 15/180
2,185,050 A * 12/1939 Chiraello ..... 132/120
(Continued)

FOREIGN PATENT DOCUMENTS

JP 48-83958 A 11/1973
JP 1-158729 U 11/1989
(Continued)

OTHER PUBLICATIONS

Reader'd Digest, What Can a Toothbrush Clean Besides Teeth? Apr. 9, 2006, pp. 1-3.*
(Continued)

*Primary Examiner* — Robyn Doan
*Assistant Examiner* — Tatiana Nobrega
(74) *Attorney, Agent, or Firm* — Oblon, McClelland, Maier & Neustadt, L.L.P.

(57) ABSTRACT

A head-hair treatment-agent applicator (1) according to the present invention has an agent applying part (2) which has a comb part (23) formed with a plurality of annularly arranged comb teeth (22), and the comb teeth (22) each have an inversely-tapered part (22*c*) in which a comb tooth width W decreases from a vicinity of a tip (22*a*) to a base end (22*e*).

24 Claims, 9 Drawing Sheets

(51) Int. Cl.

| | |
|---|---|
| ***A45D 24/26*** | (2006.01) |
| ***A45D 34/04*** | (2006.01) |
| ***A46B 11/00*** | (2006.01) |
| ***A46D 1/00*** | (2006.01) |
| *A46B 9/02* | (2006.01) |
| *A46B 3/00* | (2006.01) |

(52) U.S. Cl.

CPC ..... *A46B 11/0041* (2013.01); *A46D 1/00* (2013.01); *A46D 1/0238* (2013.01); *A46D 1/0284* (2013.01); *A46B 3/005* (2013.01); *A46B 9/023* (2013.01); *A46B 2200/1046* (2013.01)

(56) References Cited

U.S. PATENT DOCUMENTS

| | | | | | |
|---|---|---|---|---|---|
| D121,506 | S | * | 7/1940 | Davis | D4/104 |
| 3,101,086 | A | * | 8/1963 | Di Vito | 132/114 |
| 4,522,595 | A | * | 6/1985 | Selvidge | 433/142 |
| 4,865,482 | A | * | 9/1989 | Van Landingham | 401/287 |
| 5,289,833 | A | * | 3/1994 | McDonald | 132/112 |
| 5,771,904 | A | * | 6/1998 | Lange et al. | 132/159 |
| 6,000,405 | A | * | 12/1999 | De Laforcade | 132/116 |
| 6,145,513 | A | * | 11/2000 | Chu et al. | 132/112 |
| 6,176,389 | B1 | * | 1/2001 | de Laforcade | 220/695 |
| 6,286,518 | B1 | * | 9/2001 | Laporte | 132/116 |
| 7,059,333 | B2 | * | 6/2006 | Duqueroie | 132/114 |
| 8,006,705 | B2 | * | 8/2011 | Hurwitz | 132/116 |
| 2001/0018920 | A1 | * | 9/2001 | De Laforcade | 132/114 |
| 2002/0020421 | A1 | * | 2/2002 | Vayrette | 132/114 |
| 2003/0041869 | A1 | * | 3/2003 | Dovergne et al. | 132/116 |
| 2004/0016440 | A1 | * | 1/2004 | De Laforcade et al. | 132/114 |
| 2004/0177858 | A1 | * | 9/2004 | Chu et al. | 132/112 |
| 2005/0060826 | A1 | * | 3/2005 | Gavney, Jr. | 15/117 |
| 2005/0160546 | A1 | * | 7/2005 | Weihrauch | 15/207.2 |
| 2007/0000070 | A1 | * | 1/2007 | Vena et al. | 8/405 |
| 2008/0083415 | A1 | * | 4/2008 | Umeno et al. | 132/116 |
| 2009/0320868 | A1 | * | 12/2009 | Wang et al. | 132/116 |
| 2010/0299859 | A1 | * | 12/2010 | Kastl | 15/207.2 |

FOREIGN PATENT DOCUMENTS

| | | | |
|---|---|---|---|
| JP | 10 276830 | | 10/1998 |
| JP | 2001-275752 | A | 10/2001 |
| JP | 2002-537053 | A | 11/2002 |
| JP | 2004 105691 | | 4/2004 |
| JP | 2007 300958 | | 11/2007 |
| JP | 2009-160240 | A | 7/2009 |
| WO | WO 00/49905 | | 8/2000 |
| WO | WO 2006/129930 | A1 | 12/2006 |

OTHER PUBLICATIONS

International Search Report Issued Sep. 13, 2011 in PCT/JP11/63365 Filed Jun. 10, 2011.

Extended European Search Report mailed Feb. 17, 2014, in European Patent Application No. 11792556.0.

* cited by examiner

Fig. 12(a) Example 1
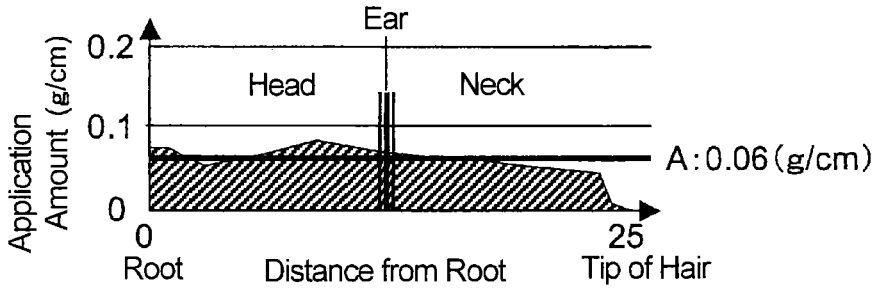
Fig. 12(b) Comparative Example 1
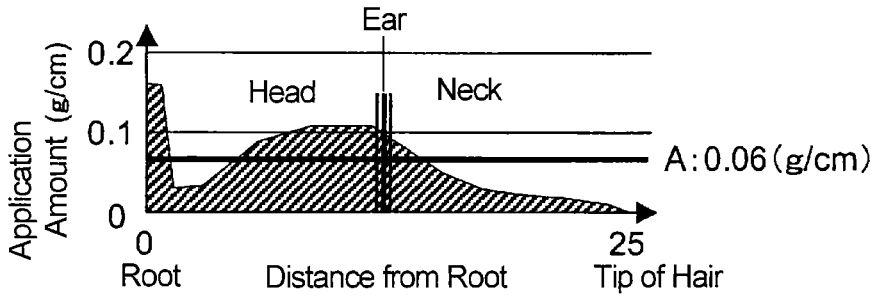
Fig. 12(c) Comparative Example 2
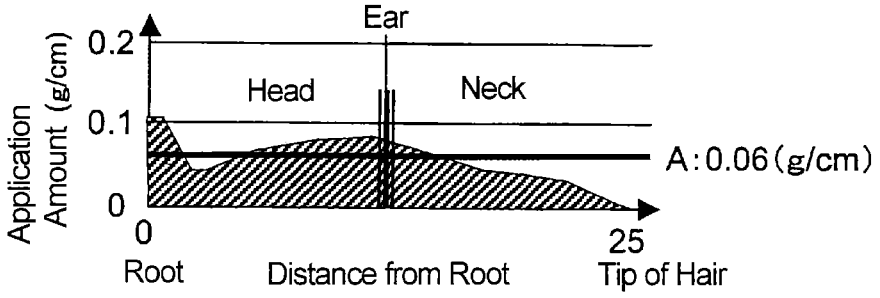

HEAD-HAIR TREATMENT-AGENT APPLICATOR

TECHNICAL FIELD

The present invention relates to a head-hair treatment-agent applicator.

BACKGROUND ART

A technique is known for applying a head-hair treatment-agent such as a hair dye to hairs using an applicator having a comb part formed with multiple comb teeth.

For example, the applicant of the present invention proposed an applicator with comb teeth which can eject an application liquid from a center part both sides of which are sandwiched by a plurality of comb tooth rows in which comb teeth are aligned straight, and apply the application liquid to the hairs while combing the hairs by the comb tooth rows (see Patent Literature 1). This applicator with the comb teeth can eject an application liquid between the comb tooth rows, and press the applicator against the hairs in a state where the application liquid is held once between the comb tooth rows.

However, as illustrated in FIG. 2 in Patent Literature 1, when the diameters of comb teeth are equal in a virtually entire area in a height direction of the comb teeth, even if, for example, an application liquid is continuously applied to the hairs in a long range from the vicinity of the head to the neck or above the shoulders, upon the application of the application liquid from the hairs positioned above the shoulders to the tips of the hairs, the hairs are not supported by the scalp from the back side and the amount of hairs decreases toward the tips of the hairs, and therefore it is expected that the hairs slip out from between the comb teeth in some cases.

Patent Literature 2 discloses an applicator which has opening parts of drop holes for ejecting a liquid in a container, in side surfaces on the tip side of comb teeth and in which bump parts are formed closer to the tip side than the opening parts and close to the opening parts, and Patent Literature 3 discloses providing projection pieces formed in upper ends of comb teeth in a comb part in which a plurality of comb teeth are linearly arranged, such that the lower surface makes an angle which is almost the right angle with respect to the center axis of comb tooth pieces.

However, the techniques of Patent Literatures 2 and 3 are techniques of ejecting agents from comb teeth, and have difficulty in stably applying agents in a long range from a the head top side to the hair tip side of long hairs. Further, the comb teeth disclosed in Patent Literature 2 each have a tapered part from a lower end of the bump part which is a tip part of the comb tooth toward the base end side and in which a comb tooth width increases toward a base end side of the comb tooth increases, and the comb teeth disclosed in Patent Literature 3 each have a uniform comb tooth width from the lower end of a given projecting piece which is the tip part of the comb tooth to the base end of the comb tooth, and cannot evenly apply an agent to each hair placed between the comb teeth.

CITATION LIST

Patent Literature

Patent Literature 1: JP 2009-160240 A
Patent Literature 2: JP-U 1-158729 A
Patent Literature 3: JP 2001-275752 A

SUMMARY OF INVENTION

Technical Problem

Hence, the present invention relates to a head-hair treatment-agent applicator which can stably apply a head-hair treatment-agent in a long range from a head top side to a hair tip side of hairs, and efficiently adhere the head-hair treatment-agent to each hair placed between comb teeth.

A head-hair treatment-agent applicator according to an aspect of the present invention includes an agent applying part which includes a comb part formed with a plurality of annularly arranged comb teeth, wherein the comb teeth each include an inversely-tapered part in which a comb tooth width decreases from a vicinity of a tip to a base end.

BRIEF DESCRIPTION OF DRAWINGS

FIG. 11(*b*) is a perspective view illustrating a shape of comb teeth of a head-hair treatment-agent applicator according to Comparative Example 1. FIG. 11(*c*) is a perspective view illustrating a shape of comb teeth of a head-hair treatment-agent applicator according to Comparative Example 2.

FIG. 12(*a*) is a graph illustrating a change in an application amount of an agent when the head-hair treatment-agent applicator according to Example 1 is used. FIG. 12(*b*) is a graph illustrating a change in an application amount of an agent when the head-hair treatment-agent applicator according to Comparative Example 1 is used. FIG. 12(*c*) is a graph illustrating a change in an application amount of an agent when the head-hair treatment-agent applicator according to Comparative Example 2 is used.

DESCRIPTION OF EMBODIMENTS

Hereinafter, the present invention will be described based on preferable embodiments with reference to the drawings.

Figure 1:
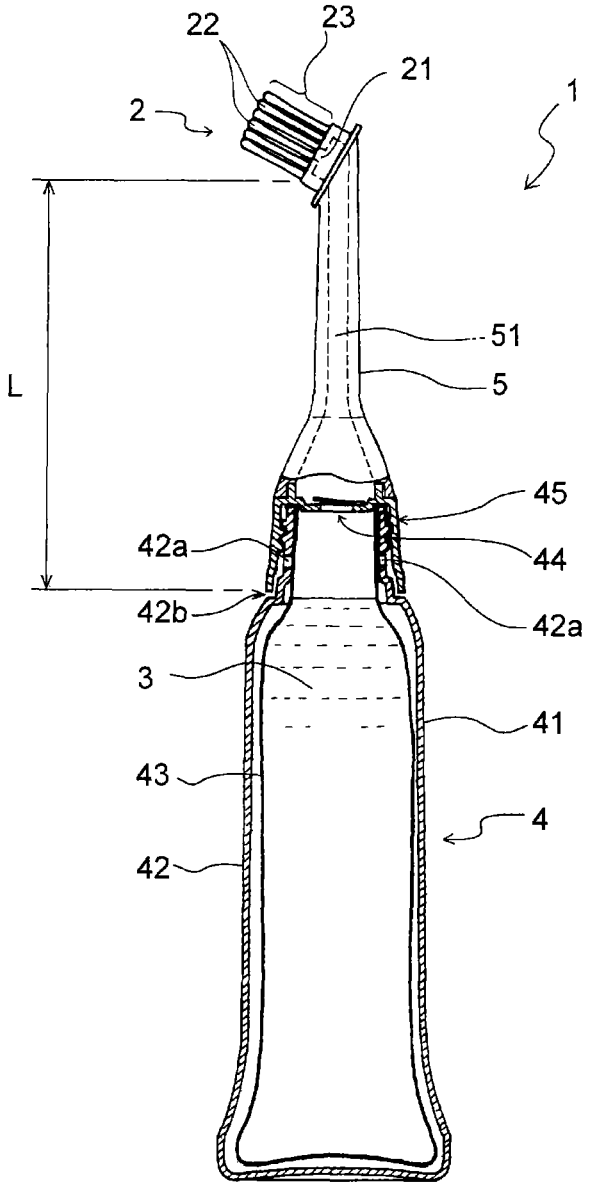
FIG. 1 is a partially broken side view illustrating an embodiment of a head-hair treatment-agent applicator according to the present invention.

As illustrated in FIG. 1, a head-hair treatment-agent applicator 1 according to a first embodiment of the present invention has an agent applying part 2 which has a comb part 23 formed with a plurality of annularly arranged comb teeth 22. The agent applying part 2 has an agent ejection port 21 for ejecting a head-hair treatment-agent 3, and the plurality of comb teeth 22 are annularly arranged to surround the periphery of the agent ejection port 21. The head-hair treatment-agent applicator 1 has a container part 4 which accommodates the head-hair treatment-agent 3, and can supply the head-hair treatment-agent 3 to the agent applying part 2. Further, the head-hair treatment-agent applicator 1 has an elongated member 5 which has a liquid guide path 51 for supplying the head-hair treatment-agent 3 from the container part 4 to the agent applying part 2.

The agent applying part 2 is a part to touch hairs, and can apply the head-hair treatment-agent 3 to the hairs while combing the hairs with the comb part 23.

Figure 2:
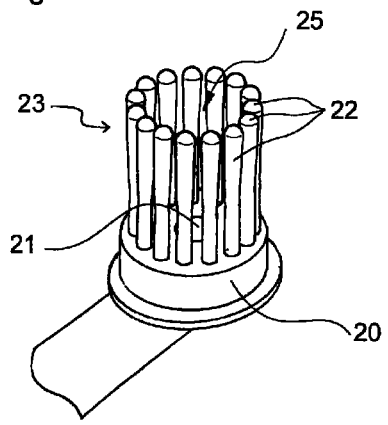
FIG. 2 is an enlarged perspective view of an agent applying part of the head-hair treatment-agent applicator in FIG. 1.
Figure 3:
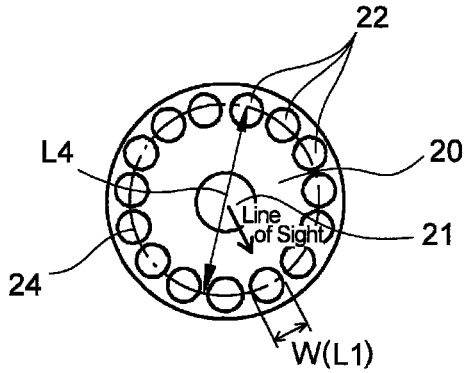
FIG. 3 is a plan view illustrating a comb tooth base of the agent applying part of the head-hair treatment-agent applicator in FIG. 1 from a surface side from which a comb part projects.

As illustrated in FIGS. 2 and 3, the agent applying part 2 according to the first embodiment has a comb tooth base 20 which has a circular shape from a plan view, and the agent ejection port 21 for ejecting the head-hair treatment-agent 3 supplied through the elongated member 5 is opened in the center part of the comb tooth base 20. The multiple comb teeth 22 are provided upright in the comb tooth base 20 to surround the periphery of the agent ejection port 21. These comb teeth 22 form the cylindrical comb part 23 on the comb tooth base 20. The comb teeth 22 and the comb tooth base 20 are integrally molded using synthetic resin.

As illustrated in FIG. 3, the comb teeth 22 according to the first embodiment each have a circular shape from a plan view and a circular cross-sectional shape, and are arranged at equal intervals on a circular line 24 which encircles the agent ejection port 21.

Figure 5:
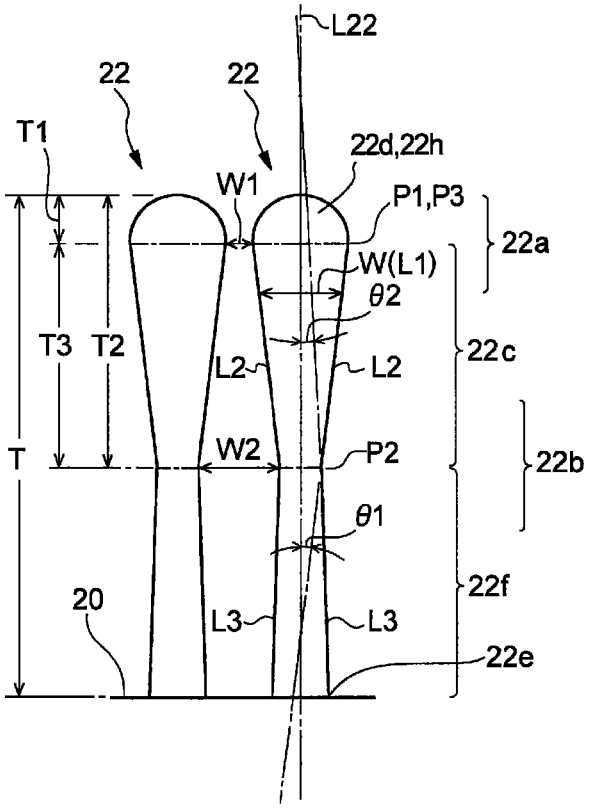
FIG. 5 is a view illustrating adjacent comb teeth of the head-hair treatment-agent applicator in FIG. 1 from an inside of a cylindrical comb part.

Further, as illustrated in FIG. 5, the comb tooth 22 has an inversely-tapered part 22*c* in which a comb tooth width W (corresponding to a diameter L1 of the comb tooth with the present embodiment) decreases from a tip vicinity part 22*a* to a base end 22*e* side of the comb tooth. The comb tooth width W refers to a projection width when the comb tooth is seen from the center part side of the agent ejection port (see FIGS. 3 and 10). With the present embodiment, the inversely-tapered part 22*c* is a part of the comb tooth 22 in which the width of a gap between the adjacent comb teeth 22 gradually increases from the tip part side to the base end part side.

The comb tooth 22 according to the first embodiment has a semispherical part 22*d* as a tip part 22*h*, and a lower end P3 of the semispherical part 22*d* (the lower end P3 of the tip part 22*h*) is an upper end P1 of the inversely-tapered part 22*c*. That is, the comb tooth 22 has the inversely-tapered part 22*c* in which the comb tooth width W (corresponding to a diameter L1 of the comb tooth with the present embodiment) decreases from the lower end P3 of the tip part 22*h* toward the base end 22*e* side of the comb tooth. When the tip part 22*h* is pressed against the head, the tip part 22*h* has a guide function of pushing hairs and easily guiding more hairs to gaps between the adjacent comb teeth.

Meanwhile, the lower end P2 of the inversely-tapered part 22*c* is positioned in the height direction center part 22*b* of the comb tooth 22.

From the view point of guiding hairs between the inversely-tapered parts of the adjacent comb teeth, as to the upper end P1 of the inversely-tapered part 22*c*, a distance T1 (see FIG. 5) from the tip of the comb tooth 22 is preferably at 0 to 5 mm, is more preferably 0 to 3 mm and is even more preferably 0 to 2 mm.

The tip vicinity part 22*a* of the comb tooth 22 is roughly in the range from the tip of the comb tooth 22 to the position 7 mm below the tip. The "tip vicinity part" according to the present invention is a concept which incorporates both the tip of the comb tooth and a portion positioned near the tip of the comb tooth, and, as in the embodiment illustrated in FIG. 9, the upper end P1 of the inversely-tapered part 22*c* may be positioned at the tip of the comb tooth.

Meanwhile, the height direction center part 22*b* of the comb tooth 22 is roughly one area in the center when the height of the comb tooth 22 is divided by three and partitioned into three areas. Although the inversely-tapered part of the comb tooth 22 may not reach the height direction center part of the comb tooth, the inversely-tapered part is preferably across the tip vicinity part of the comb tooth and the height direction center part of the comb tooth as in the present embodiment. An expression that the inversely-tapered part is across the tip vicinity part of the comb tooth and the height direction center part of the comb tooth includes that the lower end of the inversely-tapered part is positioned in the height direction center part of the comb tooth, and that the inversely-tapered part is across an area further below the height direction center part (see FIG. 8).

As to the lower end P2 of the inversely-tapered part 22*c*, a distance T2 (see FIG. 5) from the tip of the comb tooth 22 is preferably 10 to 100% of a height T (see FIG. 5) of the comb tooth 22, is more preferably 30 to 100% and is even more preferably 50 to 100%.

Further, a height T3 of the inversely-tapered part 22*c* (see FIG. 5 for the difference in height between the upper end P1 and the lower end P2) is preferably 10 to 100% of the height T of the comb tooth 22, is more preferably 30 to 100% and is even more preferably 50 to 100%.

Figure 6:
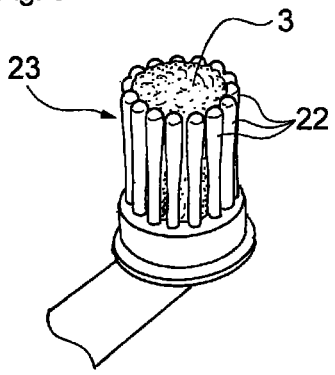
FIG. 6 is a perspective view illustrating a state where a liquid or mousse head-hair treatment-agent is accumulated in space inside the cylindrical comb part of the head-hair treatment-agent applicator in FIG. 1.

As to the comb part 23 and the head-hair treatment-agent 3, as illustrated in FIG. 6, when the head-hair treatment-agent 3 is ejected by directing the comb part 23 above, preferably, a predetermined amount of the head-hair treatment-agent 3 can be accumulated inside the cylindrical comb part 23.

Various known head-hair treatment-agents such as a hair dye, a bleaching agent, styling spritz, a hair growth agent and a hair-care agent can be used for the head-hair treatment-agent 3, and the composition of each agent is not particularly limited. However, from the view point of ejecting the head-hair treatment-agent 3 at a position apart from the head and then carrying the ejected agent to the head while preventing the agent from spilling over from the cylindrical comb part 23, preferably, the head-hair treatment-agent 3 can be ejected from the agent ejection port 21 as a liquid having viscosity to some degree (including a creamy liquid or a liquid including solid content or gas) or mousse. The head-hair treatment-agent to be ejected from the agent ejection port 21 as mousse may be mousse when the head-hair treatment-agent is filled in the container part 4, may change into mousse in the container part 4 or may change into mousse between the container part 4 and the agent ejection port 21. Meanwhile, the viscosity of the head-hair treatment-agent is preferably 5000 to 30000 mPa·s (20° C.), and is more preferably 10000 to 20000 mPa·s (20° C.).

From the view point of applying an agent to hairs over a certain degree of an application width and a certain degree of a length according to one applying operation of moving the agent applying part 2 once from the head top side of the head to a hair tip direction of the hairs, in case of a woman who has about 20 to 25 cm of the hair length, the height T of the comb teeth 22 is preferably 5 to 30 mm, is more preferably 10 to 20 mm and is even more preferably 12 to 18 mm.

Further, from the same view point, an inner diameter L4 (see FIG. 3) of a circular line 24 on which the center of the cross section of the base end part of the comb tooth 22 passes is preferably 5 to 30 mm, is more preferably 5 to 20 mm and is even more preferably 5 to 15 mm. The range of this inner diameter L4 is a range which provides a preferable streak width when the applicator according to the present invention is implemented by way of streaking (part of hairs is bleached or dyed in a streak).

As to the comb tooth 22 according to the first embodiment, comb tooth visible outlines L2 and L2 on both sides of the inversely-tapered part 22C are each linear. As to the comb tooth visible outlines L2 and L2 on both sides of the inversely-tapered part 22*c*, an inclined angle θ1 (see FIG. 5) with respect to an axis center line L22 of the comb tooth 22 is, for example, 0.5 to 20 degrees, is more preferably 1 to 10 degrees and is even more preferably 2 to 5 degrees. In such a range, the inversely-tapered parts of the adjacent comb teeth rub hairs and the head-hair treatment-agent each other, so that the head-hair treatment-agent is likely to permeate not only in the surface of a hair bundle but also inside the hair bundle. Further, the hair bundle in which the head-hair treatment-agent permeates easily moves to the base end part, so that it is possible to evenly apply the head-hair treatment-agent from the root to the tip of the hairs. In addition, the comb tooth visible outlines L2 and L2 on both sides of the inversely-tapered part 22*c* may have curved shapes curved in a direction apart from the center axis line L22 of the comb tooth 22 in a convex or concave shape.

Further, as to a gap between the adjacent comb teeth 22, a width W1 (shortest distance) between the upper ends P1 of the inversely-tapered parts 22 is preferably 0.1 to 3 mm and is more preferably 0.3 to 1 mm. In such a range, the hair bundle guided to the inversely-tapered part is not likely to be pulled out, and it is possible to rub hairs and the head-hair treatment-agent well. Further, as to the gap between the adjacent comb teeth 22, a maximum width W2 below the upper ends P1 of the inversely-tapered parts 22*c* is preferably 0.2 to 5 mm and is more preferably 0.8 to 2 mm. In such a range, it is easy to move the hair bundle in which the head-hair treatment-agent permeates, to the base end part.

The comb tooth 22 according to the first embodiment has, below the inversely-tapered part 22*c*, a tapered part 22*f* in which the comb tooth width W (diameter L1) increases toward a base end 22*e*. As to comb tooth visible outlines L3 and L3 on both sides of the tapered part 22*f*, an inclined angle θ2 (see FIG. 5) with respect to the axis center line L22 of the comb tooth 22 is, for example, 0.5 to 5 degrees and is more preferably 0.5 to 2 degrees. In such a range, a mold adopting a special structure becomes unnecessary, so that it is easy to mold the agent applying part 2. In addition, the inclined angle θ2 of the tapered part 22*f* is preferably smaller than the inclined angle θ1 of the inversely-tapered part 22*c*.

Below the inversely-tapered part 22*c*, a same diameter part having a certain diameter in the vertical direction is also preferably formed instead of forming the tapered part 22*f*. Further, below the inversely-tapered part 22*c*, it is possible to provide the tapered part 22*f* and the same diameter part. In this case, as to the tapered part 22*f* and the same diameter part, the tapered part 22*f* side may be formed on the base end 22*e* side, and the same diameter part side may be formed on the base end 22*e* side.

Figure 4:
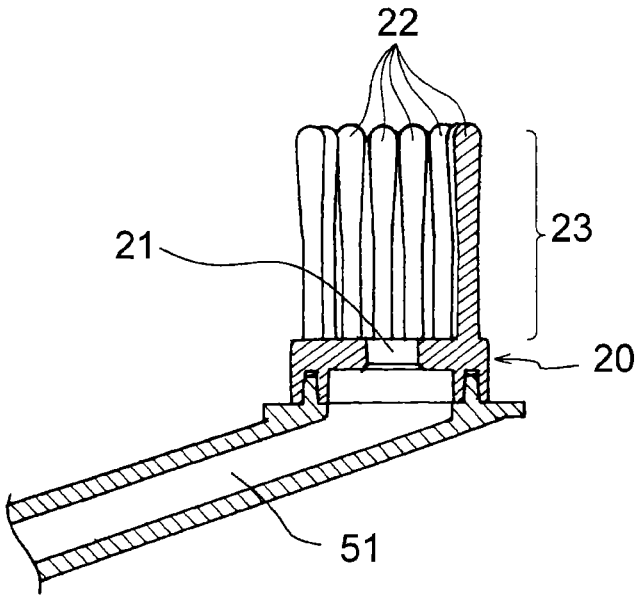
FIG. 4 is a partial sectional view illustrating the agent applying part of the head-hair treatment-agent applicator in FIG. 1 and the vicinity thereof.

As illustrated in FIG. 1, the container part 4 in the head-hair treatment-agent applicator 1 according to the first embodiment is a double structure container formed with a container body 41 which has a cylindrical outer container 42 with a closed bottom which can be squeezed, and an inner bag 43 which is arranged in the outer container 42 and has an opening jointed air tight to the inner surface of a cylindrical opening of the outer container 42, and a connection cap 45 with a check valve 44 attached to the opening of the container body 41. By gripping and squeezing the outer container 42 by one hand, the outer container 42 or air between the outer container 42 and the inner bag 43 presses the inner bag 43 provided inside, so that the head-hair treatment-agent 3 in the inner bag 43 is pushed out and is supplied to the agent ejection port 21 through the liquid guide path 51. Further, the elongated member 5 forming a predetermined interval between the container part 4 and the agent applying part 2 is jointed to the upper part of the connection cap 45, and, as illustrated in FIG. 4, the other end of the elongated member 5 is jointed to the back surface side of the comb tooth base 20. The elongated member 5 has the liquid guide path 51 inside, and communicates between the container part 4 and the agent ejection port 21 through the liquid guide path 51.

In the head-hair treatment-agent applicator 1 illustrated in FIG. 1, a suction hole 42*a* which communicates between space between the outer container 42 and the inner bag 43 and an outside of the outer container 42 is formed in the cylindrical opening of the outer container 42. Further, when the outer container 42 which is pressed and deformed returns to the original state by means of the elastic restoring force, air outside the container 1 passes a gap 42*b*, which is provided between the lower end of the connection cap 45 and the outer container 42, and the suction hole 42*a*, and flows in between the outer container 42 and the inner bag 43. The container part 4 employs this configuration, so that it is possible to gradually eject a head-hair treatment-agent which is content, from an agent ejection port by repeating an operation of pressing and deforming the outer peripheral surface.

By using such a double structure container for the container part 4, it is possible to prevent the container part 4 from being shriveled and being difficult to grip even when the remaining amount of the head-hair treatment-agent 3 decreases inside. Further, by providing the connection cap 45 and the check valve 44 to, for example, the liquid guide path 51 which communicates between space inside the container part 4 and the agent ejection port 21, and preventing a reverse flow of air to the liquid guide path 51 and the container part 4 after the agent is ejected, it is possible to prevent the agent from being difficult to be ejected or being scattered when the agent is ejected next. Furthermore, from, for example, the view point of facilitating visual checking of a state where an agent is applied to hairs and the view point of facilitating an applying operation, the distance L (see FIG. 1) from the part of the outer container 42 of the container part 4 which is not covered by the connection cap 45 to the comb part 23 is preferably 40 to 120 mm and is more preferably 70 to 90 mm.

A preferable example of a method of applying a head-hair treatment-agent using the head-hair treatment-agent applicator 1 according to the first embodiment will be described.

Figure 7:
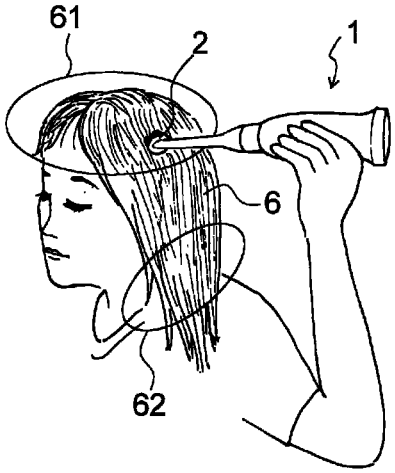
FIG. 7 is a perspective view illustrating how a head-hair treatment-agent is applied to hairs using the head-hair treatment-agent applicator in FIG. 1.

First, the connection cap 45 is removed from the container body 41 of the container part 4, and the head-hair treatment-agent 3 is filled in the container part 4. Further, by gripping the outer container 42 by one hand and repeatedly squeezing the outer container 42 after the connection cap 45 is attached, the head-hair treatment-agent 3 inside the container part 4 is supplied to the agent applying part 2, and the head-hair treatment-agent 3 is ejected from the agent ejection port 21. Furthermore, as illustrated in FIG. 6, a desired amount of the head-hair treatment-agent 3 is accumulated inside the cylindrical comb part 23, and, as illustrated in FIG. 7, the agent applying part 2 which holds the head-hair treatment-agent 3 is then moved to the head and the comb part 23 is pressed against the hair side.

Still further, the agent applying part 2 is moved toward the hair tip direction of the hairs, and the head-hair treatment-agent 3 is applied to the hairs placed between the adjacent comb teeth 22 while combing the hairs with the comb part 23.

With the head-hair treatment-agent applicator 1 according to the first embodiment, the comb teeth 22 forming the comb part 23 each have the inversely tapered part 22*c*, so that, when the comb part 23 is pressed against the hairs and moved, the hairs come into gaps between the comb teeth 22 and these hairs are guided in the base part direction of the comb teeth 22 without being accumulated near the tip parts of the comb teeth 22.

Hence, not only the head-hair treatment-agent near the tip parts of the comb teeth in the cylindrical comb part 23 but also the head-hair treatment-agent 3 near the comb tooth base are effectively applied to the hair.

Further, the comb tooth 22 has the inversely-tapered part 22*c*, so that, when the agent is applied to hairs 6 above the shoulders 62 which are not supported by the scalp from the back side or when the agent is applied to a site near the tips of hairs at which the thickness of hairs and the number of hairs decrease, the hairs are hardly pulled out from between the comb teeth 22. Consequently, it is possible to stably apply the head-hair treatment-agent 3 even to the hairs 6 above the shoulders 62, hairs above the shoulders, and the site near the tips of the hairs. By this means, it is also possible to stably apply the head-hair treatment-agent 3 to, for example, the hairs 6 in the long range from a head top vicinity 61 to the shoulders 62 or above the shoulders.

Further, when the comb part 23 of the applicator according to the present invention which is provided with the semispherical part 22*d* as the tip part 22*h* is pressed against the hair side, the semispherical part 22*d* guides more hairs to the gaps between the adjacent comb teeth 22. Furthermore, when the agent applying part 2 is moved toward the hair tip direction of the hairs in a state where the hairs are in the gaps, the hair bundle is rubbed between the inversely-tapered parts 22*c* of the adjacent teeth 22, and the head-hair treatment-agent 3 is efficiently adhered to each hair inside the hair bundle. By this means, it is possible to evenly treat hairs.

Further, as illustrated in FIG. 3, the comb teeth 22 according to the first embodiment are annularly arranged in a circular virtual line, therefore, the head-hair treatment-agent applicator has an advantage that it is possible to apply an agent to hairs with the same width even when the agent is applied slightly differently upon application.

Next, another embodiment of the present invention will be described.

Figure 8:
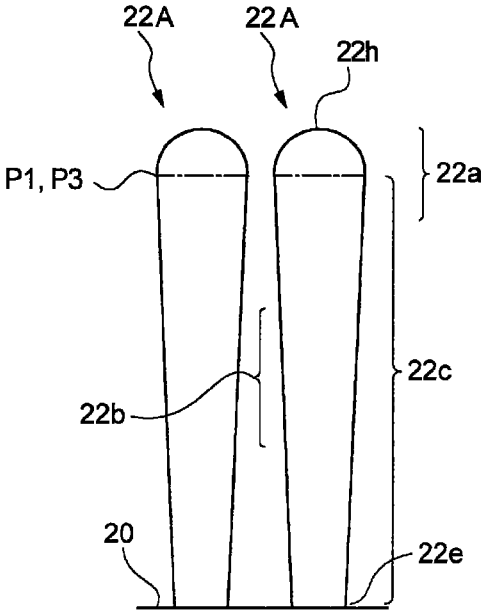
FIG. 8 is a view (corresponding to FIG. 5) illustrating comb teeth of another embodiment according to the present invention.
Figure 9:
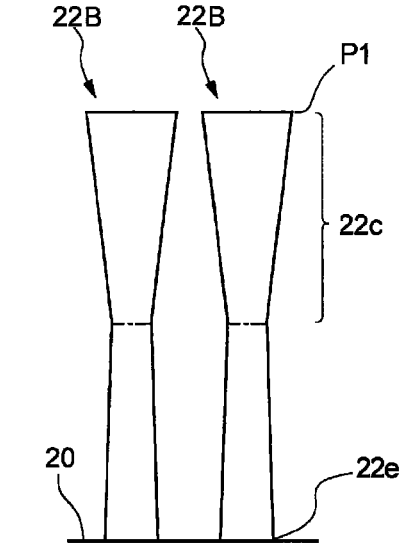
FIG. 9 is a view (corresponding to FIG. 5) illustrating comb teeth according to still another embodiment of the present invention.
Figure 10A:
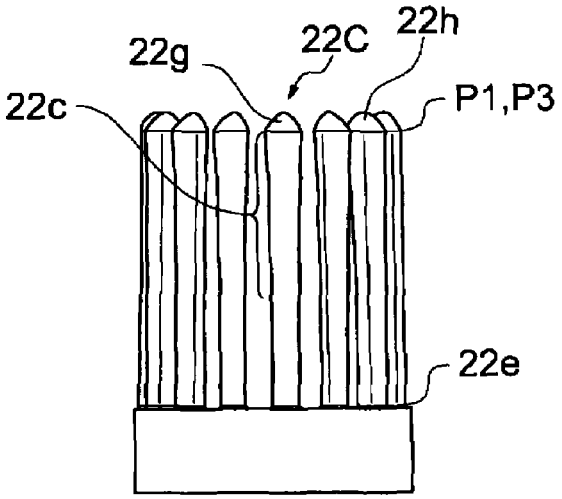
FIGS. 10(*a*) (side view), 10(*b*) (perspective view) and 10(*c*) (plan view) are views illustrating an agent applying part according to still another embodiment of the present invention.
Figure 10B:
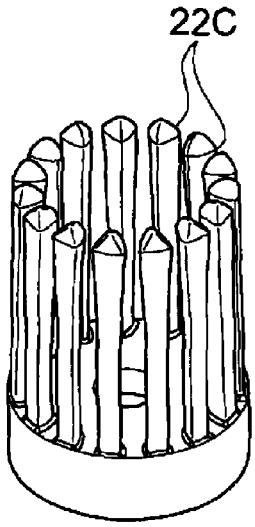
Figure 10C:
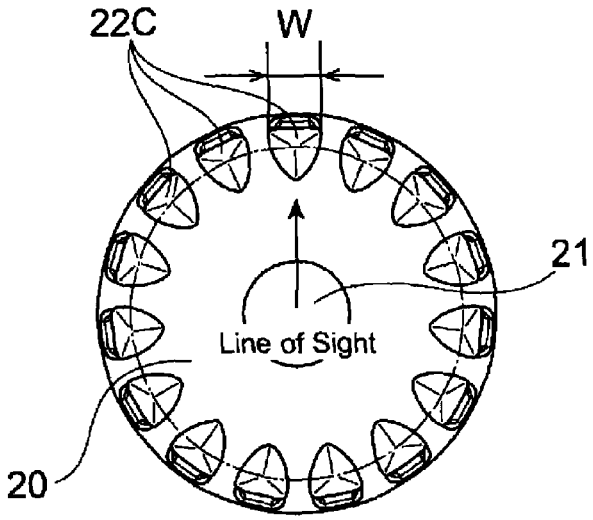

FIGS. 8 and 9 are views (corresponding to FIG. 5) illustrating comb teeth of head-hair treatment-agent applicators according to second and third embodiments of the present invention. FIGS. 10(*a*), 10(*b*) and 10(*c*) are views that illustrate an agent applying part of a head-hair treatment-agent applicator according to a fourth embodiment of the present invention.

The head-hair treatment-agent applicators according to the second to fourth embodiments employs the same configuration as in the first embodiment except shapes of comb teeth. The above description in the first embodiment (including, for example, description of the more preferable configuration) is adequately applied to points of the second to fourth embodiments which will not be described in particular.

As illustrated in FIG. 8, as to the inversely tapered part 22*c* of the comb tooth 22A according to the second embodiment, the diameter continuously decreases from a tip vicinity part 22*a* to the base end 22*e* beyond the height direction center part 22*b*. Similar to the comb tooth 22A according to the second embodiment, the inversely tapered part 22*c* of the comb tooth 22 may be across the tip vicinity part 22*a* and the base end 22*e* beyond the height direction center part 22*b*.

As illustrated in FIG. 9, a comb tooth 22B according to a third embodiment does not have a semispherical part in an upper end part, and the upper end is planar. Hence, an upper end P1 of the inversely tapered part 22*c* is positioned at the tip of the comb tooth.

As illustrated in FIGS. 10(*a*), 10(*b*) and 10(*c*), a comb tooth 22C according to the fourth embodiment has a virtually triangular shape which has a non-circular cross-sectional shape, and is provided with the inversely-tapered part 22*c* which has a virtually triangular pyramid part 22*g* as the tip part 22*h* and in which the comb tooth width W decreases (a gap between adjacent comb teeth expands) from a lower end P3 of the tip part 22*h* toward the base end 22*e* side of the comb tooth. In addition, the shape on the outer periphery side of the comb part 23 is straight, so that it is possible to simplify a mold structure for molding the comb part.

According to both of the second and fourth embodiments, the comb teeth 22A and 22C have the inversely-tapered parts 22*c* in which the comb tooth widths W decrease from the lower ends P3 of the tip parts 22*h* toward the base end 22*e* side of the comb teeth, so that it is possible to provide the same function and effect as in the first embodiment.

Also, according to the third embodiment, the comb teeth 22B each have the inversely-tapered part 22*c* in which the comb tooth width W decreases from the tip of the comb tooth toward the base end 22*e* side of the comb tooth, so that it is possible to provide the same function and effect as in the first embodiment.

In addition, preferably, the comb tooth according to the present invention has, for example, the tip part 22*h* which has a tapered shape like the comb teeth according to the first, second and fourth embodiments, and the lower end P3 of the tip part 22*h* is the upper end P1 of the inversely-tapered part 22*c* from the view point of smoothly guiding hairs to gaps between comb teeth.

Although the preferable embodiments of the present invention have been described above, the present invention is by no means limited to the above embodiments, and can be variously modified without deviating from the spirit of the present invention.

For example, a comb tooth may have a plurality of inversely-tapered parts apart in the height direction. In this case, a straight part with an even comb tooth width or diameter or a forward tapered part in which the comb tooth width or the diameter increases toward the base end side may be provided between the plurality of inversely-tapered parts.

Further, comb teeth may be aligned on an oval line or may be aligned on a polygonal line such as square or hexagonal instead of being aligned on a circular line as illustrated in FIG. 3.

Furthermore, as illustrated in FIGS. 5 and 10, instead of providing a semispherical part or a virtually triangular pyramid part above the inversely-tapered part, conical or truncated conical tip parts with rounded tips may continue above the inversely-tapered part with bottom surfaces positioned on the inversely-tapered part side. In addition to the semispherical tip parts (semispherical parts) according to the first and second embodiments and a virtually triangular pyramid tip part (virtually triangular pyramid part) according to the fourth embodiment, a conical tip part, a polygonal (for example, triangular pyramid, square pyramid, pentagonal pyramid or six-sided pyramid) tip part, and truncated conical and polygonal truncated pyramid tip parts are examples of tip parts of tapered shapes. The tip parts of the tapered shapes preferably have tips rounded in a convex curve shape.

In addition, a portion having a wider comb tooth width or a lager diameter than the inversely-tapered part 22*c* is not preferably formed above the upper end P1 of the inversely-tapered part 22*c*.

Further, the head-hair treatment-agent applicator according to the present invention may not have the container part 4 or the agent ejection port 21. Even when the agent applying part 2 does not have the agent ejection port 21, it is possible to apply a head-hair treatment-agent in the same manner as in the present embodiment by, for example, directly injecting a head-hair treatment-agent from, for example, another container in space surrounded by the annularly arranged comb teeth 22.

Further, the container part may not adopt a double structure, and may be a tube container which can push out content by crushing or rolling up the tube container. Furthermore, the connection cap may not have a check valve.

Still further, an aerosol container may be used for a container part.

EXAMPLE

Hereinafter, the present invention will be further described in details based on Examples. However, the scope of the present invention is by no means limited to these Examples.

Example 1

Figure 11A:
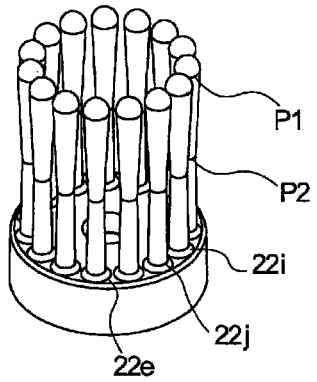
FIG. 11(*a*) is a perspective view illustrating a shape of the comb teeth of the head-hair treatment-agent applicator according to Example 1.
Figure 11B:
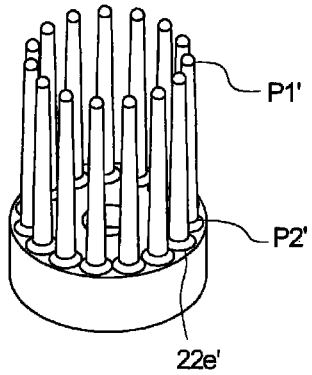
Figure 11C:
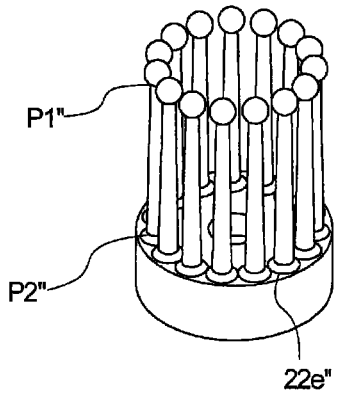

A head-hair treatment-agent applicator according to Example 1 is manufactured according to a head-hair treatment-agent applicator in modes illustrated in FIGS. 1 to 5. With Example 1, a round chamfered part (fillet part) 22*i* is provided to each comb tooth base end from the view point of improving the strength of the comb tooth. FIG. 11(*a*) illustrates the shape of the comb tooth according to Example 1. An applicator is made as a trial by a casting mold method using urethane resin.

The dimension of each part is as follows (see FIG. 5 for symbols T, T1, T2, W1 and W2, and see FIG. 3 for L4).

The height T of a comb tooth (a distance from the tip of a comb tooth to a base end 22*e* of the comb tooth): 16 mm The distance T1 from the tip of the comb tooth to an upper end P1 of an inversely-tapered part: 1 mm The distance T2 from the tip of the comb tooth to a lower end P2 of the inversely-tapered part: 9 mm The distance from the tip of the comb tooth to an upper end 22*j* of the round chamfered part (fillet part) 22*i*: 15.6 mm The diameter of the comb tooth in the upper end P1 of the inversely-tapered part: 2 mm The diameter of the comb tooth in the lower end P2 of the inversely-tapered part: 1.3 mm The diameter of the comb tooth in the base end 22*e*: 2.5 mm The diameter of the comb tooth in the upper end 22*j* of the round chamfered part (fillet part) 22*i*: 1.5 mm The inner diameter L4 of a circular line on which comb teeth are aligned: 12 mm The number of comb teeth: 15

The distance W1 between adjacent comb teeth in the upper end P1 of the inversely-tapered part: 0.5 mm.

The distance W2 between adjacent comb teeth in the lower end P2 of the inversely-tapered part: 1.2 mm

Comparative Example 1

A head-hair treatment-agent applicator employing the same configuration as in Example 1 is manufactured except that a comb tooth has a semispherical part having the radius of 0.5 mm as a tip part of the comb tooth, and has a tapered part in which the diameter continuously increases from a lower end of the semispherical part (corresponding to P1' described below) toward the base end side. FIG. 11(*b*) illustrates the shape of a comb tooth according to Comparative Example 1. The dimension of each part is as follows.

The height of a comb tooth (corresponding to T): 15.5 mm

The distance (corresponding to T1) from a tip of the comb tooth to an upper end (P1') of a tapered part: 0.5 mm The distance (corresponding to T2) from the tip of the comb tooth to a lower end (P2') of the tapered part: 15 mm The diameter of the comb tooth in the upper end (P1') of the tapered part: 1 mm The diameter of the comb tooth in the lower end (P2') of the tapered part (the diameter of the comb tooth in the upper end of a round chamfered part): 1.5 mm The diameter of the comb tooth in a base end 22*e'*:2.5 mm The inner diameter (corresponding to L4) of a circular line on which comb teeth are aligned: 12 mm The number of comb teeth: 15

The distance (corresponding to W1) between adjacent comb teeth in the upper end (P1') of the tapered part: 1.5 mm The distance (corresponding to W2) between adjacent comb teeth in the lower end (P2') of the tapered part: 1 mm

Comparative Example 2

A head-hair treatment-agent applicator employing the same configuration as in Example 1 is manufactured except that a comb tooth has a spherical part having the radius of 2 mm as a tip part, and has a tapered part in which the diameter continuously increases from a tip side toward the base end side below the spherical part. The diameter of an upper end part of the tapered part adjacent to the spherical part is 1 mm. The dimension of each part is as follows.

The height (corresponding to T) of a comb tooth: 16 mm

The distance (corresponding to T1) from a tip of the comb tooth to an upper end (P1") of a tapered part: 1.9 mm The distance (corresponding to T2) from the tip of the comb tooth to a lower end (P2") of the tapered part: 15.5 mm The diameter of the comb tooth in the upper end (P1") of the tapered part: 1 mm The diameter of the comb tooth in the lower end (P2") of the tapered part (the diameter of the comb tooth in the upper end of the round chamfered part): 1.5 mm The diameter of the comb tooth in a base end 22*e"*: 2.5 mm The inner diameter (corresponding to L4) of a circular line on which the comb teeth are aligned: 12 mm The number of comb teeth: 15

The distance (corresponding to W1) between adjacent comb teeth in the upper end (P1") of the tapered part: 1.5 mm The distance (corresponding to W2) between adjacent comb teeth in the lower end (P2") of the tapered part: 1 mm FIG. 11(*c*) illustrates the shape of a comb tooth according to Comparative Example 2.

Evaluation

Evenness of the application amount and agent permeability are evaluated according to the following method and evaluation criteria using the head-hair treatment-agent applicators according to Example and Comparative Examples.

Evenness of Application Amount (Method)

A head-hair treatment-agent is applied to hairs of a head model (mannequin) imitating the head and the neck of a woman.

A bleach agent including the following composition is used as the head-hair treatment-agent.

Further, the head-hair treatment-agent is applied by accumulating the head-hair treatment-agent in a cylindrical comb part in a state illustrated in FIG. 6, then pressing an agent applying part against hairs on the head, and next moving the agent applying part from the vicinity of the head of the head model (mannequin) to a position below the neck while combing the hairs.

(Composition of Head-Hair Treatment-Agent)

Primary agent (solution such as ammonia or ammonium hydrogen carbonate): 60 mass %

Secondary agent (solution such as hydrogen peroxide): 21 mass %

Powder agent (persulfate, and the like): 19 mass %

FIG. 12 illustrates a change in the application amount when an agent is applied from a site (root) near the top of the head from which the agent starts being applied, to the tips of hairs. Meanwhile, although there are three vertical lines in center parts of FIGS. 12(*a*) to (*c*), the center lines represent the positions of the ears. The line on the left side represents a boundary with respect to an area which is above the ears and which supports hairs by the scalp from the back side in the head. The line on the right side represents a boundary with respect to an area (neck) which is below the ears and which does not support hairs by the scalp from the back side in the head. Further, evenness of the application amount is evaluated according to the following evaluation criteria, and the result is shown in Table 1. In addition, a straight line A in each graph illustrated in FIG. 12 indicates the mass (g/cm) of an agent which is necessary to treat hairs in unit length.

(Evaluation Criteria)

+1 point: The application amount exceeds an A value in 70% or more of a length area in the entire area from the root to the tip of hairs, and 50% or more of the A value is applied to hairs in the entire area.

0 point: The application amount exceeds the A value in 50% or more of the length area.

−1 point: An area in which the application amount exceeds the A value is 50% or less.

TABLE 1

| | Example 1 | Comparative Example 1 | Comparative Example 2 |
|---|---|---|---|
| Evenness of Application Amount | +1 | −1 | 0 |
| Agent Permeability | +1 | −1 | −1 |

Agent Permeability (Method)

A head-hair treatment-agent is applied to hairs of a head model (mannequin) imitating the head and the neck of a woman.

The agent including the above-mentioned composition is used as the head-hair treatment-agent.

Further, the head-hair treatment-agent is applied by accumulating the head-hair treatment-agent in a cylindrical comb part in a state illustrated in FIG. 6, then pressing an agent applying part against hairs on the head, and next moving the agent applying part from the vicinity of the head of the head model (mannequin) to a position below the neck while combing the hairs.

(Evaluation Criteria)

+1 point: An applied part (the surface of a hair bundle) is wet with a treatment-agent, and when the hair bundle is detangled, the hair bundle is wet to the inside with the treatment-agent (the treatment-agent permeates the inside of the hair bundle).

−1 point: Although the applied part (the surface of the hair bundle) is wet with the treatment agent, when the hair bundle is detangled, the hair bundle is not wet to the inside with the treatment-agent (the treatment-agent does not permeate the inside of the hair bundle).

As is clear from the result shown in table 1, the head-hair treatment-agent applicators according to Examples have good evenness of the application amount and agent permeability. The reason why agent permeability is good is because hairs more than usual are placed between comb teeth by a hair guiding unit, and the agent is applied while a hair bundle is rubbed between inversely-tapered parts of adjacent comb teeth.

INDUSTRIAL APPLICABILITY

The head-hair treatment-agent applicator according to the present invention can stably apply a head-hair treatment-agent in a long range from a head top side to a hair tip side of hairs, and efficiently adhere the head-hair treatment-agent to each hair placed between the comb teeth.

The invention claimed is:

1. A head-hair treatment-agent applicator, comprising:

an agent applying part which includes a comb part formed with a plurality of annularly arranged comb teeth, wherein each comb tooth of the comb teeth includes an inversely-tapered part in which a width of the inversely-tapered part of the comb tooth decreases from a vicinity of a tip portion of the comb tooth toward a base end of the comb tooth, each said tip portion having a tapered part starting at an interface with the inversely-tapered part and reaching an apex of the tip portion, a gap between adjacent comb teeth expands from a vicinity of the tip portion of the comb tooth toward the base end of the comb tooth, each of the comb teeth has a triangular cross-sectional shape such that the tapered part of the tip portion forms a prism with the interface as its base, the comb teeth are oriented in a planar view such that each of the comb teeth has a flat surface that defines an outermost portion of the comb tooth in a radial direction, the comb teeth are annularly arranged around an agent ejection port, and for each of the comb teeth, the triangular shape of the cross-section includes:

a first vertex that is a point of the triangular shape of the cross-section that is closest to a center portion of the agent applying part, and second and third vertices that are points of the triangular shape of the cross-section that are closest to, respectively, adjacent comb teeth.

2. The applicator according to claim 1, wherein the inversely-tapered part extends from the vicinity of the tip portion of the comb tooth to a center part of the comb tooth in a height direction.

3. The applicator according to claim 1, wherein:

the agent applying part includes the agent ejection port to eject a head-hair treatment-agent, the plurality of comb teeth are annularly arranged to surround the agent ejection port in the planar view, and the head-hair treatment-agent applicator includes a container part which accommodates a head-hair treatment-agent, and which is configured to supply the head-hair treatment-agent to the agent applying part.

4. The applicator according to claim 3, wherein the comb teeth are annularly arranged in a circular shape in the planar view and are on a comb tooth base in which the agent ejection port is open.

5. The applicator according to claim 3, wherein the head-hair treatment-agent ejected from the agent ejection port is liquid or mousse.

6. The applicator according to claim 3, wherein the container part is configured to gradually eject content from the agent ejection port by repeating an operation of pressing and deforming an outer peripheral surface.

7. The applicator according to claim 3, wherein the annularly arranged comb teeth are arranged in an oval shape or a polygonal shape in the planar view and are on a comb tooth base in which the agent ejection port is open.

8. The applicator according to claim 1, wherein the annularly arranged comb teeth surround, in the planar view, a space configured to accumulate a head-hair treatment-agent.

9. The applicator according to claim 1, wherein the height of each of the comb teeth is 5 to 30 mm.

10. The applicator according to claim 1, wherein, for each of the comb teeth, a distance from the apex of the tip portion to a lower end of the inversely-tapered part is 50 to 100% of the height of the comb tooth.

11. The applicator according to claim 1, wherein a distance between adjacent comb teeth at an upper end of the inversely-tapered part is 0.1 to 3 mm.

12. The applicator according to claim 1, wherein a distance between adjacent comb teeth at a lower end of the inversely-tapered part is 0.2 to 5 mm.

13. The applicator according to claim 1, further comprising:

a container part which accommodates a head-hair treatment-agent, and which is configured to supply the head-hair treatment-agent to the agent applying part; and an elongated member which has a liquid guide path to supply the head-hair treatment-agent from the container part to the agent applying part, wherein one end of the elongated member is jointed to the container part, and an other end of the elongated member is jointed to the agent ejection port of the agent applying part.

14. The applicator according to claim 1, wherein, for each of the comb teeth, both sides of an outline of the inversely-tapered part, from a side view thereof, are linear and are inclined with respect to a center axis line of the comb tooth by 0.5 to 20 degrees.

15. The applicator according to claim 1, wherein each of the comb teeth further includes a tapered part, which has an inverted taper relative the inversely-tapered part, provided below the inversely-tapered part, with respect to a height direction of the comb tooth, such that a width of the tapered part increases from a vicinity of the inversely-tapered part toward the base end of the comb tooth.

16. The applicator according to claim 15, wherein, for each of the comb teeth, both sides of an outline of the tapered part, from a side view thereof, are linear and are inclined with respect to a center axis line of the comb tooth by 0.5 to 5 degrees.

17. The applicator according to claim 1, wherein, for each of the comb teeth, a distance from the tip portion to an upper end of the inversely-tapered part is 5 mm, and a height of the inversely-tapered part is 50% of the height of the comb tooth.

18. The applicator according to claim 1, wherein each of the comb teeth has a flat surface, the flat surface, in the planar view, being adjacent to an outer perimeter of a circular tooth base to which the comb teeth are mounted.

19. The applicator according to claim 18, wherein the flat surface is inversely tapered.

20. The applicator according to claim 1, wherein, for each of the comb teeth, the triangular shape of the cross-section of the inversely-tapered part includes a combination of straight and curved edges.

21. The applicator according to claim 1, wherein, for each of the comb teeth, an entire length thereof has a cross-section that is triangular in shape.

22. The applicator according to claim 21, wherein the cross-sectional shape of the comb tooth varies in terms of area along the length of the comb tooth in a height direction of the comb tooth.

23. A head-hair treatment application device, comprising a head-hair treatment applicator, the applicator comprising:

an agent applying part which includes a comb part formed with a plurality of annularly arranged comb teeth;

a container part which accommodates a head-hair treatment-agent, and which is configured to supply the head-hair treatment-agent to the agent applying part; and an elongated member which has a liquid guide path to supply the head-hair treatment-agent from the container part to the agent applying part, wherein a comb tooth of the comb teeth includes an inversely-tapered part in which a width of the inversely-tapered part of the comb tooth decreases from a vicinity of a tip portion of the comb tooth toward a base end of the comb tooth, said tip portion having a tapered part starting at an interface with the inversely-tapered part, each of the comb teeth has a triangular cross-sectional shape such that the tapered part of the tip portion forms a prism with the interface as its base, a gap between adjacent comb teeth expands from a vicinity of the tip portion toward the base end, each said comb tooth is oriented in a planar view so as to have a flat surface that defines an outermost portion of said comb tooth in a radial direction, the comb teeth are annularly arranged around an ejection port, and for each of the comb teeth, the triangular cross-section includes:

a first vertex that is a point of the triangular cross-section that is closest to a center portion of the agent applying part, and second and third vertices that are points of the triangular cross-section that are closest to, respectively, adjacent comb teeth.

24. A method for treating hair with a head-hair treatment-agent applicator, the applicator comprising an agent applying part which includes a comb part formed with a plurality of annularly arranged comb teeth, wherein a comb tooth of the comb teeth includes an inversely-tapered part in which a width of the inversely-tapered part of the comb tooth decreases from a vicinity of a tip portion of the comb tooth toward a base end of the comb tooth, said tip portion having a tapered part starting at an interface with the inversely-tapered part, said comb tooth having a triangular cross-sectional shape such that the tapered part of the tip portion forms a prism with the interface as its base, a gap between adjacent comb teeth expands from a vicinity of the tip portion toward the base end, each said comb tooth is oriented in a planar view so as to have a flat surface that defines an outermost portion of said comb tooth in a radial direction, the comb teeth are annularly arranged around an ejection port, and for each of the comb teeth, the triangular cross-section includes: a first vertex that is a point of the triangular cross-section that is closest to a center portion of the agent applying part, and second and third vertices that are points of the triangular cross-section that are closest to, respectively, adjacent comb teeth, the method comprising:

accumulating a head-hair treatment-agent in the agent applying part;

pressing the comb teeth of the agent applying part against the hair; and moving the agent applying part toward a hair tip direction of the hair.

* * * * *